United States Patent [19]

Gerlach

[11] Patent Number: 4,579,496

[45] Date of Patent: Apr. 1, 1986

[54] MOBILE CONCRETE BATCH PLANT

[76] Inventor: Stanley C. Gerlach, 4401 N. Indiana, Oklahoma City, Okla. 73112

[21] Appl. No.: 683,058

[22] Filed: Dec. 18, 1984

[51] Int. Cl.[4] ..... E04H 7/26

[52] U.S. Cl. ..... 414/21; 366/18; 414/332

[58] Field of Search ..... 366/18, 30, 35, 37; 414/21, 332, 919

[56] References Cited

U.S. PATENT DOCUMENTS

| | | | |
|---|---|---|---|
| 1,548,014 | 7/1925 | Hetherington | 414/21 X |
| 2,271,434 | 1/1942 | Johnson | 414/21 |
| 2,310,592 | 2/1943 | Noble | 414/501 X |
| 2,756,881 | 7/1956 | Sims | 414/683 X |
| 2,800,312 | 7/1957 | Ruby | 366/18 |
| 2,896,770 | 7/1959 | Ross et al. | 414/21 X |
| 2,896,771 | 7/1959 | Mecham | 414/21 X |
| 2,975,884 | 3/1961 | Kayser | 414/21 X |
| 3,024,930 | 3/1962 | Sims | 414/332 |
| 3,029,958 | 4/1962 | Ruby | 414/21 |
| 3,064,832 | 11/1962 | Heltzel | 414/332 |
| 3,090,501 | 5/1963 | Auld | 414/21 |
| 3,154,202 | 10/1964 | Heltzel | 414/332 |
| 3,159,288 | 12/1964 | Heise | 414/332 |
| 3,198,494 | 8/1965 | Curran et al. | 366/18 |
| 3,207,327 | 9/1965 | Long | 414/21 |
| 3,251,484 | 5/1966 | Hagan | 414/21 |
| 3,295,698 | 1/1967 | Ross et al. | 414/21 |
| 3,343,688 | 9/1967 | Ross | 366/18 X |
| 3,406,839 | 10/1968 | Heltzel | 414/21 |
| 3,476,270 | 11/1969 | Cox et al. | 414/21 |
| 3,586,181 | 6/1971 | Brock | 414/332 |
| 3,820,762 | 6/1974 | Bostrom et al. | 366/18 |
| 3,872,980 | 3/1975 | Hagan | 414/21 |
| 3,905,586 | 12/1975 | Wall, Jr. | 366/18 |
| 3,938,673 | 2/1976 | Perry, Jr. | 414/332 X |
| 3,945,619 | 3/1976 | Taibi | 366/18 |
| 3,998,436 | 12/1976 | Allen et al. | 366/18 |
| 4,178,117 | 12/1979 | Brugler | 414/21 |
| 4,249,351 | 2/1981 | Brock | 414/332 X |
| 4,268,209 | 5/1981 | Hankins et al. | 414/332 |
| 4,337,014 | 6/1982 | Farnham | 414/332 |
| 4,339,207 | 7/1982 | Placzek | 366/18 |
| 4,465,420 | 8/1984 | Dillman | 414/332 |

FOREIGN PATENT DOCUMENTS 520641 6/1953 Belgium .

OTHER PUBLICATIONS

Advertisement by Hubart Metal Products Co., Oct. 28, 1958.

*Primary Examiner*—Philip R. Coe

*Attorney, Agent, or Firm*—Dunlap, Codding & Peterson

[57] ABSTRACT

A mobile concrete batch plant including a wheeled, tilting main frame upon which are mounted a collection hood, an aggregate weigh batcher, and a cement weigh batcher. The collection hood is positioned at an end of the main frame that is raised above the ground when the batch plant is erected and the cement weight batcher is positioned above the collection hood. The aggregate weigh batcher is positioned at the opposite end of the main frame and a conveyor is provided between the aggregate weight batcher and the collection hood. A secondary frame is pivotally attached to the tilting main frame between the weigh batchers and a cement silo is pivotally attached to the secondary frame. The secondary frame carries screw conveyors to convey cement from the cement silo to the cement weigh batcher so that the batch plant can be erected by tilting the main frame, pivoting the secondary frame on the main frame to raise the screw conveyors above the cement weigh batcher, and tilting the silo to a vertical position over the main and secondary frames.

19 Claims, 14 Drawing Figures

MOBILE CONCRETE BATCH PLANT

BACKGROUND OF THE INVENTION

1. Field of the Invention

The present invention relates generally to improvements in mobile equipment used in the construction industry and, more particularly, but not by way of limitation, to mobile equipment for producing batches of concrete from cement and aggregate.

2. Brief Description of the Prior Art

When concrete is used in construction at an out-of-the-way site, it is often advantageous to temporarily erect a concrete batch plant in the vicinity of the construction site to provide batches of cement, aggregate and water to concrete mixing trucks that are then required to travel only a short distance between the construction site and the batch plant. Once the construction project for which the batch plant is erected has been completed, the batch plant can be dismantled and moved to a new site to be again erected to provide concrete for a new construction project. A variety of types of concrete batch plants designed to be used in this manner are known in the prior art.

While the use of mobile concrete batch plants has proved to be a useful technique in the construction industry, problems have existed with their use. In particular, it has been necessary in the past to make compromises between various desirable characteristics of these plants. For example, transportability of a concrete batch plant can be enhanced by making the plant in several parts which are transported separately but such construction of the batch plant often requires the use of heavy machinery to erect the batch plant once it has reached its destination. Additionally, a great deal of time and inconvenience can be involved in the erection of a batch plant that is transported in several parts. Alternatively, a batch plant can be transported in essentially the configuration in which it will be positioned during use to minimize the time of erection and the use of heavy machinery to accomplish the erection, but such alternative results in transportation difficulties because of the large bulk of a concrete batch plant. This problem is especially severe where the batch plant is to have a high production rate. As a result, it has been necessary in the past to sacrifice some desirable characteristics of a concrete batch plant in order to enhance other characteristics which the plant designer deems to be more important.

SUMMARY OF THE INVENTION

The present invention provides a mobile concrete batch plant that is characterized by ease of transportation from one location to another and, at the same time, by ease of erection using only a winch that can be mounted on a truck by means of which the batch plant is brought to the site at which it is to operate. To this end, the batch plant of the present invention is constructed in a manner that will permit erection by successive pivoting of major components thereof. Specifically, the batch plant of the present invention is comprised of a wheeled, tiltable main frame that can be positioned at an angle to the horizontal by attaching a cable to the batch plant and drawing forward portions of the main frame upwardly by operating a winch to which the cable is attached. Once the main frame has been tilted and blocked into position, a cement silo that is pivotally mounted on a secondary frame that, in turn, is pivotally mounted on the main frame, can be pivoted on the secondary frame by releasing clamps holding the silo to the secondary frame and continuing the operation of the winch to draw the silo upwardly until the silo has reached a preselected angle to the longitudinal extent of the secondary frame. Clamps holding the secondary frame to the main frame can then be released so that continued operation of the winch will draw the secondary frame upwardly until the secondary frame is disposed at a preselected angle to the main frame. When the secondary frame reaches this angle, the silo is brought into a vertical position in which the lower end of the silo rests on the earth's surface so that all that is necessary to complete the erection of the batch plant is to block the secondary frame into position at an angle to the main frame.

In order to provide for the preparation of a mix of aggregate, cement and water to be discharged into a concrete mixing truck, a collection hood is located at the end of the main frame that is raised when the main frame is tilted, an aggregate weigh batcher is mounted on the opposite end of the main frame, a cement weigh batcher is mounted on the main frame above the collection hood, and integral conveyors are mounted on the main frame and secondary frame to convey aggregate and cement from the aggregate weigh batcher to the collection hood and from the silo to the cement weigh batcher respectively. Thus, the placement of the concrete batch plant of the present invention into operation requires only that the batch plant be erected as described above, the conveyor in the secondary frame be connected between the cement silo and the cement weigh batcher, that the aggregate weigh batcher and cement silo be charged and that a source of water for the collection hood be provided.

An object of the present invention is to provide a concrete batch plant that can be easily moved from one location to another while, at the same time, can be quickly and easily placed into operation once the batch plant has reached a particular destination.

Another object of the present invention is to provide a mobile concrete batch plant that can be erected without the use of heavy machinery.

Yet another object of the present invention is to provide a concrete batch plant that folds into a compact batch plant that can be easily transported along roads and highways.

Other objects, advantages and features of the present invention will become clear from the following detailed description of the batch plant when read in conjunction with the drawings and the appended claims.

DESCRIPTION OF THE PREFERRED EMBODIMENT

Figure 1:
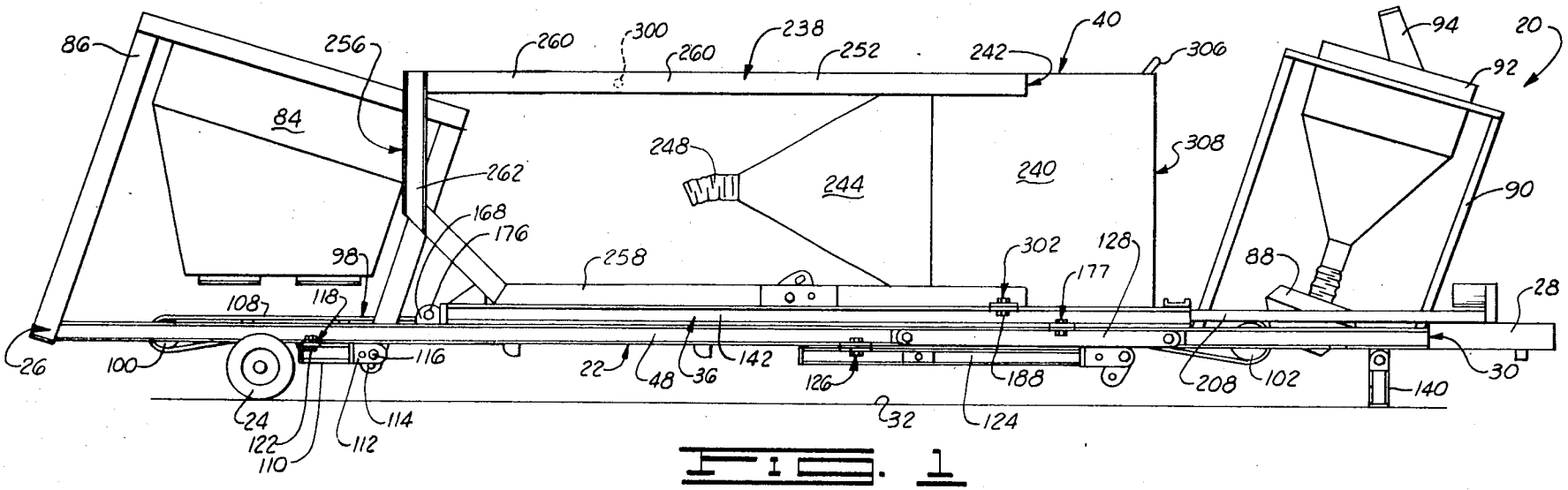
FIG. 1 is an elevational side view of a concrete batch plant constructed in accordance with the present invention illustrating the batch plant in a transport configuration in which the batch plant is moved from one location to another.
Figure 2:
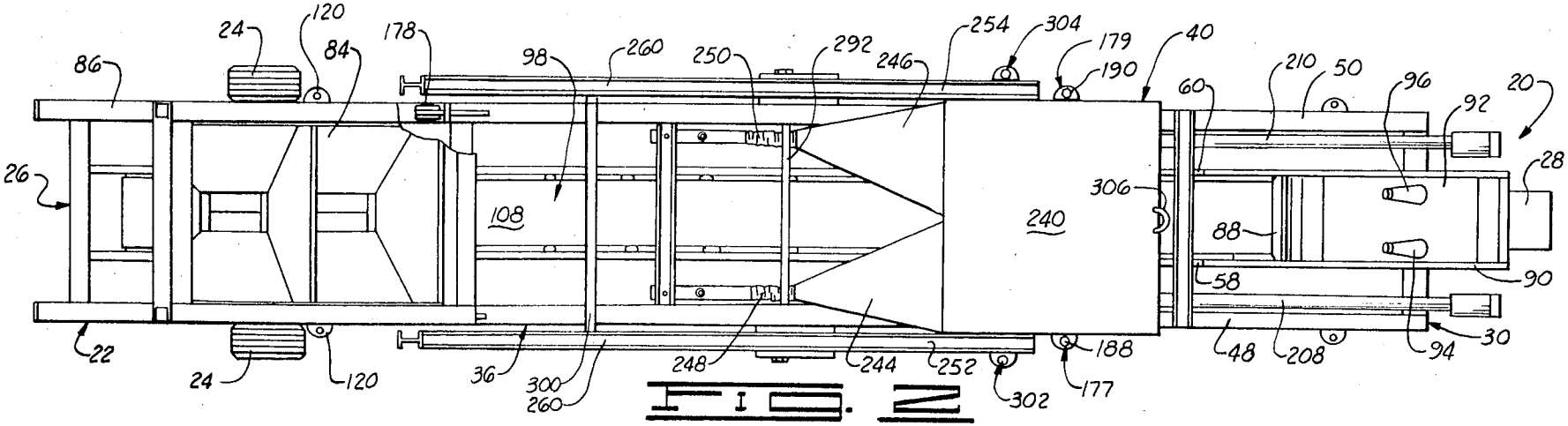
FIG. 2 is a plan view of the batch plant in the transport configuration.
Figure 3:
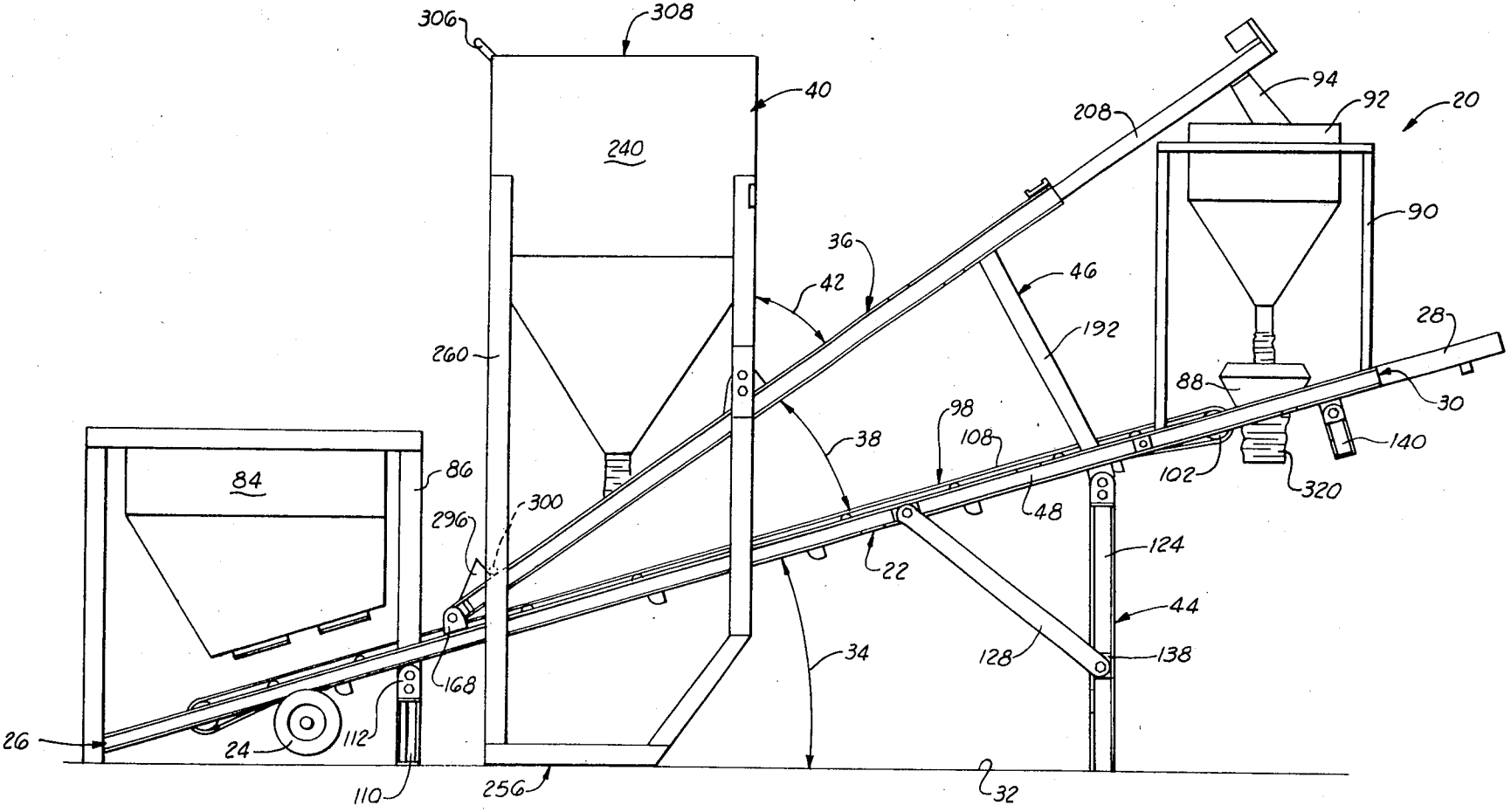
FIG. 3 is a side elevational view of the batch plant in an erected configuration in which the batch plant provide batches of aggregate, cement and water to concrete mixing trucks.

Referring now to the drawings in general and to FIGS. 1-3 in particular, shown therein and designated by the general reference numeral 20 is a mobile concrete batch plant constructed in accordance with the present invention. As shown in these figures, the batch plant 20 is comprised of a main frame 22 that is mounted on wheels 24 disposed near a first end 26 of the main frame and is provided with a tow connection 28 extending from the opposite, or second, end 30 of the main frame 22 so that the batch plant 20 can be placed in a transport configuration shown in FIG. 1 and, in such configuration, can be drawn along the earth's surface 32 by a conventional tow truck (not shown in FIG. 1). As shown in FIG. 3, the main frame 22 can be tilted into a position in which the main frame 22 is disposed at an angle 34 to the earth's surface 32 so that the first end 26 of the main frame 22 is substantially at ground level while the second end 30 thereof is raised a distance above the earth's surface 32 to permit a concrete mixing truck (not shown) to be driven under the second end 30 of the main frame 22 to receive measured quantities of aggregate, cement and water from the batch plant 20.

The batch plant 20 is further comprised of a secondary frame 36 which is pivotally connected to the main frame 22 so that the secondary frame 36 can be placed in a first position, shown in FIG. 1, in which the secondary frame engagingly overlays central portions of the main frame 22. Alternatively, the secondary frame 36 can be placed in a second position, shown in FIG. 3, in which the secondary frame 36 extends upwardly at an angle 38 from the main frame 22. A silo 40 is similarly pivotally attached to the secondary frame 36 for disposition in a first position in which the silo 40 engagingly overlays the secondary frame 36 and, alternatively, for disposition in a second position, shown in FIG. 3, in which the silo 40 extends upwardly at an angle 42 from the secondary frame 36. The angles 34, 38 and 40 are selected to equal 90° so that the silo 40 will be positioned horizontally in the transport configuration of the batch plant 20, as shown in FIG. 1, and will be positioned vertically in the erected configuration of the batch plant 20 that has been shown in FIG. 3.

The batch plant 20 further comprises a main frame support assembly 44 that supports the main frame at the angle 34 in the erected configuration of the batch plant 20 and a secondary frame support assembly 46 that similarly supports the secondary frame in the second position of the secondary frame 36 on the main frame 22 in the erected configuration of the batch plant 20.

Figure 4:
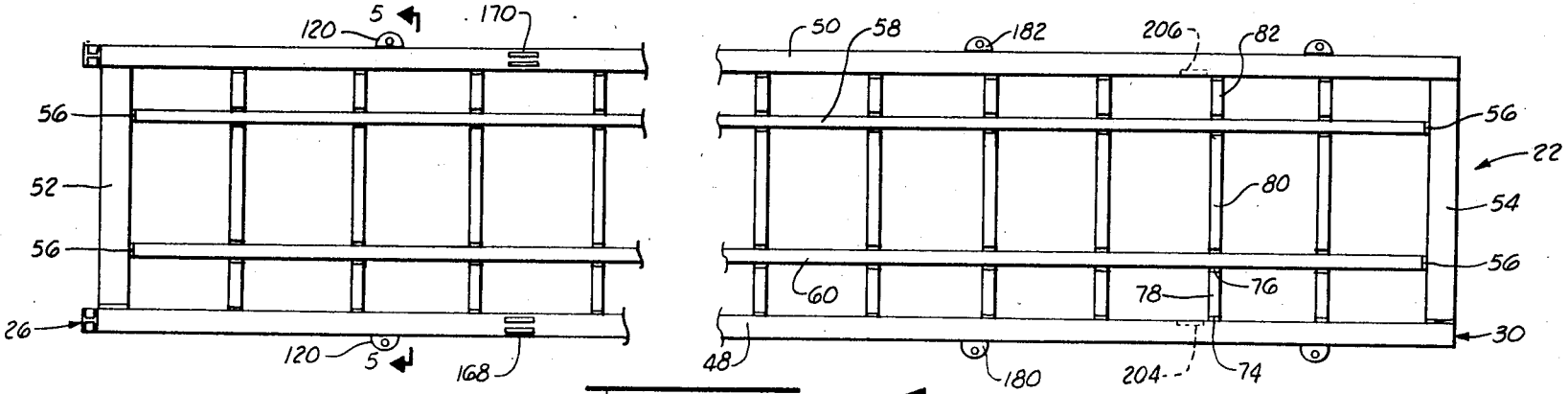
FIG. 4 is a plan view of a main frame of the batch plant shown in FIG. 1.
Figure 5:
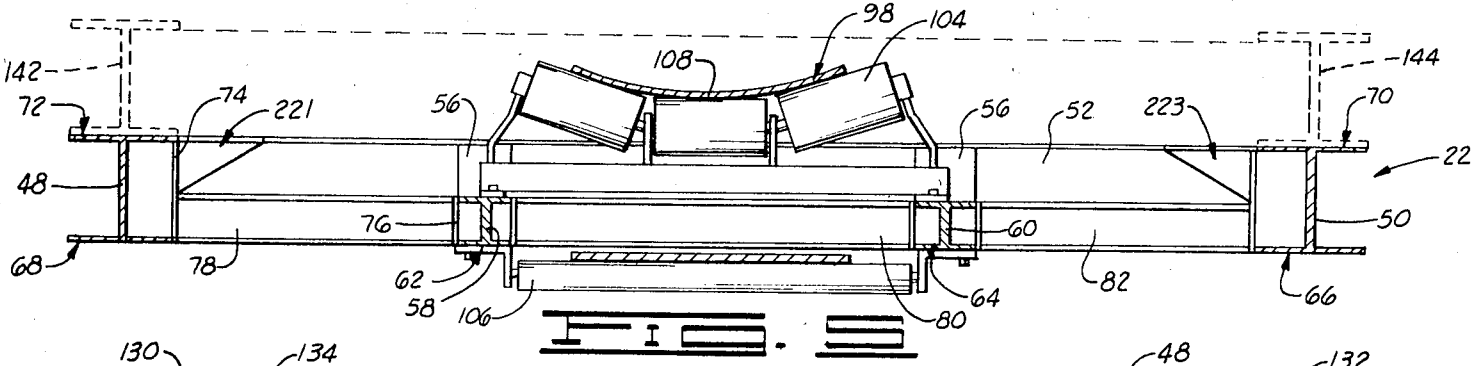
FIG. 5 is a cross section of the main frame taken along line 5—5 of FIG. 4.

Referring now to FIGS. 4 and 5, shown therein is the construction of the main frame 22. In general, the main frame 22 is comprised of two parallel main frame base beams 48, 50 that extend longitudinally from the first end 26 of the main frame 22 to the second end 30 thereof. As shown in FIG. 5, each of the base beams 48 and 50 is a length of standard steel H-beam. End beams 52 and 54 are welded between the base beams 48 and 50 to extend across the first and second ends, 26 and 30 respectively, of the main frame 22. Like the base beams 48 and 50, the end beams 52 and 54 can suitably be constructed of standard steel H-beam.

A plurality of plates 56 are welded to the facing sides of the end beams 52, 54 between the base beams 48 and 50 and the main frame 22 is further comprised of two interior beams 58 and 60 that are welded to aligned pairs of the plates 56 so that the interior beams extend substantially the length of the main frame 22 between the end beams 52 and 54 as shown in FIG. 4. The interior beams 58 and 60 are constructed of steel H-beam that is smaller than the H-beam of which the base beams 48 and 50 are constructed; for example, the base beams 48 and 50 can be constructed of eight inch H-beam while the interior beams 58 and 60 are constructed of four inch H-beam, and the interior beams 58 and 60 are placed between the base beams 48 and 50 such that the lower sides 62 and 64 of the interior beams 58 and 60 are on a level with the lower sides 66 and 68 of the base beams 48 and 50 to define a lower side of the main frame 22. The upper sides 70, 72 of the base beams 48 and 50 similarly define an upper side for the main frame 22. A plurality of plates 74 are welded to the interior side of the base beam 48 and a plurality of plates 76 (only one plate 74 and one plate 76 have been numerically designated in FIG. 4) are welded to the side of the interior beam 58 facing the base beam 48 so that a plurality of bolsters 78 can be welded between the plates 74 and 76 to strengthen portions of the main frame 22 along the base beam 48 thereof. Bolsters 80 and 82 are similarly welded between the interior beams 58 and 60 and between the interior beam 60 and the base beam 68 as shown in FIGS. 4 and 5. (For clarity of illustration, the bolsters 78, 80 and 82 have not been illustrated in FIG. 2.)

Referring once again to FIGS. 1-3, the batch plant 20 further comprises a conventional aggregate weigh batcher 84 that is mounted on portions of the main frame 22 adjacent the first end 26 thereof via a framework 86 that supports the aggregate weigh batcher 84 a short distance above the main frame 22. Portions of the framework 86 extend over the first end 26 of the main frame 22 to form part of the main frame support assembly 44 used to support the main frame 22 at the angle 34 above the earth's surface 32. Adjacent the second end 30 of the main frame 22, the batch plant 20 further comprises a conventional collection hood 88 that is mounted on the interior beams 58 and 60 as indicated in FIG. 2. A framework 90 is mounted partially on the interior beams 58 and 60 and partially on the end beam 54 to support a conventional cement weigh batcher 92 above the collection hood 88. The cement weigh batcher 92 is provided with inlets 94 and 96 to receive cement and deliver weighed batches of cement to the collection hood 88. A first conveyor 98 is mounted on the main frame 22 to extend between the aggregate weigh batcher 84 and the collection hood 88 to similarly deliver weighed batches of aggregate to the collection hood 88. The first conveyor 98 is preferably a conventional belt conveyor comprised of rollers 100 and 102 mounted on the interior beams 58 and 60, a plurality of troughing rollers 104 (FIG. 5) mounted atop the interior beams 58 and 60, a plurality of straight roller 106 (FIG. 5) mounted on the underside of the interior beams 58 and 60, an endless belt 108 that passes over the rollers 100–106 and a conventional drive motor (not shown) to turn the roller 102 whereby aggregate deposited on the belt 108 can be transported by the first conveyor 98 to the collection hood 88 in a conventional manner. A water pipe (not shown) can be extended along one of the main frame base beams 48 and 50 in a manner known in the art to deliver measured quantities of water to the collection hood 88 so that measured quantities of cement, aggregate and water can be delivered to the collection hood 88 and discharged therefrom into a concrete mixing truck in a conventional manner.

The aggregate weigh batcher 84, cement weigh batcher 92, and collection hood 88 are of conventional construction so that, with the exception of one feature of the cement weigh batcher 92 and collection hood 88, these components of the concrete batch plant 20 need not be further discussed for purposes of this disclosure. The one feature of the cement weigh batcher 92 and the collection hood 88 that enters into one inventive aspect of the present invention is illustrated in FIG. 2. That is, and as shown in FIG. 2, the cement weigh batcher 92, collection hood 88, and the framework 90 upon which mounts the cement weigh batcher 92 on portions of the main frame 22 adjacent the second end 30 thereof are confined to central portions of the main frame 22. In particular, the weigh batcher 92, framework 90 and collection hood 88 are positioned only over those portions of the main frame 22 defined by the separation of the interior beams 58 and 60. Thus, the region above portions of the main frame 22 adjacent the base beams 48 and 50 and adjacent the second end 30 of the main frame 22 are unobstructed for a reason to be discussed below.

In addition to a portion of the framework 86 that supports the aggregate weigh batcher 84, the main frame support assembly 44 further comprises a leg 110 that is pivotally attached to the underside of the base beam 48. The leg 110 is positioned directly below portions of the framework 86 that supports the aggregate weigh batcher 84 that are remote from the first end 26 of the main frame 22 to form a continuation of the framework 86 to the earth's surface when the batch plant 20 is placed in the erected configuration as shown in FIG. 3. As illustrated in FIGS. 1 and 3, the leg 110 is preferably constructed of H-beam having a clevis 112 at the upper end thereof to receive a depending tab 114 (FIG. 1) that is welded to the base beam 48 upon which the leg 110 is mounted. The clevis 112 and tab 114 have a pair of holes formed therethrough so that the clevis 112 and tab 114 can be pivotally connected via a bolt 116 passing through the uppermost holes formed through the clevis 112 and tab 114 and rigidly connected, when the leg 110 extends from the main frame 22 in the manner shown in FIG. 3, by a second bolt that is passed through the lower holes formed through the clevis 112 and tab 114. When the batch plant 20 is placed in the transport configuration, the leg 110 is folded upwardly against the underside of the base beam 48 and secured in position via a clamp 118 comprised of apertured plates 120 (FIG. 4) that are welded to the lowermost webs of the base beam 48 to extend laterally therefrom, similar apertured plates (not numerically designated in the drawings) welded to and extending laterally from the leg 110, and a fastener (a nut and a bolt) 122 that extends through the apertures in such plates to secure the plates in vertical juxtaposition at the sides of the main frame 22. A second leg (not shown), identical to the leg 110, is identically mounted on the underside of the base beam 50.

Figure 6:
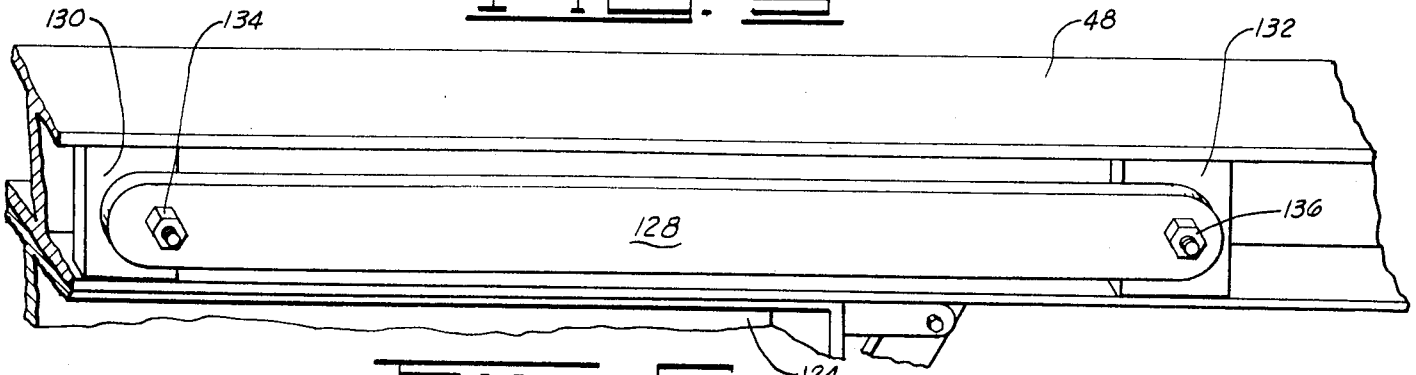
FIG. 6 is a fragmentary side elevational view of the main frame illustrating the mounting of a brace used in the support of the main frame at an angle to the horizontal.

Near the second end 30 of the main frame 22, the main frame support assembly 44 similarly comprises a leg 124 that is pivotally connected to the base beam 48 in the same manner that the leg 110 is pivotally connected to the base beam 48 so that the leg 124 can be clamped to the underside of the base beam 48 via a clamp 126 that is identical to the clamp 118 or extended downwardly to support portions of the main frame 22 adjacent the second end 30 thereof as illustrated in FIG. 3. The main frame support assembly 44 further comprises a brace 128 to connect the leg 124 to the base beam 48 as shown in FIG. 3 and maintain the leg 124 in the extended position shown in such figure. The connection of the brace 128 to the main frame 22 has been illustrated in FIG. 6. As shown in FIG. 6, two plates 130, 132 are welded between the upper and lower webs of the main frame base beam 48 about the connection of the leg 124 to the base beam 48. The plates 130, 132 are separated by a distance equal to the length of the brace 128 and the plates 130, 132 are provided with apertures (not shown) that align with similar apertures (not shown) in end portions of the brace 128 so that the brace 128 can be secured alongside the base beam 48, as shown in FIGS. 1 and 6 by fasteners 134 and 136 that pass through the holes formed through the end portions of the brace 128 and through the holes in the plates 130 and 132 respectively. A plate 138 that is similar to the plates 130, 132 is welded between two webs of the leg 124 and is provided with a hole (not shown) by means of which the brace 128 can be bolted to the leg 124 in the same manner that the brace 128 is bolted to the plates 130, 132. When the batch plant 20 is placed in the erected configuration shown in FIG. 3, the fastener 136 is removed from the brace 128 and the plate 132 shown in FIG. 6, the brace 128 is repositioned to extend downwardly at an angle to the main frame 22 so that the hole (not shown) formed through one end of the brace 128 is aligned with the hole (not shown) formed through the plate 138 and the fastener 136 is then passed through the holes in the plate 138 and the end portion of the brace 128 adjacent thereto to secure the brace 128 between the base beam 48 and the leg 124 as shown in FIG. 3. The leg 124 and brace 128 thus support portions of the batch plant 20 near the second end 30 thereof and adjacent the base beam 48. Support for such portions of the plant 20 adjacent the base beam 50 is provided by a leg and brace (not shown) that are identical to the leg 124 and brace 128 and mounted on the base beam 50 in the same manner that the leg 124 and brace 128 are mounted on the base beam 48.

As will be discussed below, the truck that delivers the concrete batch plant 20 to a site at which the plant 20 is to be erected is utilized to carry out the erection of the plant 20. In order to support portions of the batch plant 20 adjacent the second end 30 of the main frame 22 while the truck is positioned to place the batch plant 20 in the erected configuration, a leg 140 is pivotally attached to the underside of the base beam 48 as illustrated in FIG. 1 and a clamp (not numerically designated in the drawings) is provided on the base beam 48 and on the leg 140 to permit securing of the leg 140 to the underside of the base beam 48 during transport of the batch plant 20 from one site to another in the same manner that the legs 110 and 124 are secured to the underside of the base beam 48 during transport. An identical leg (not shown) is identically attached to the underside of the base beam 50.

Figure 7:
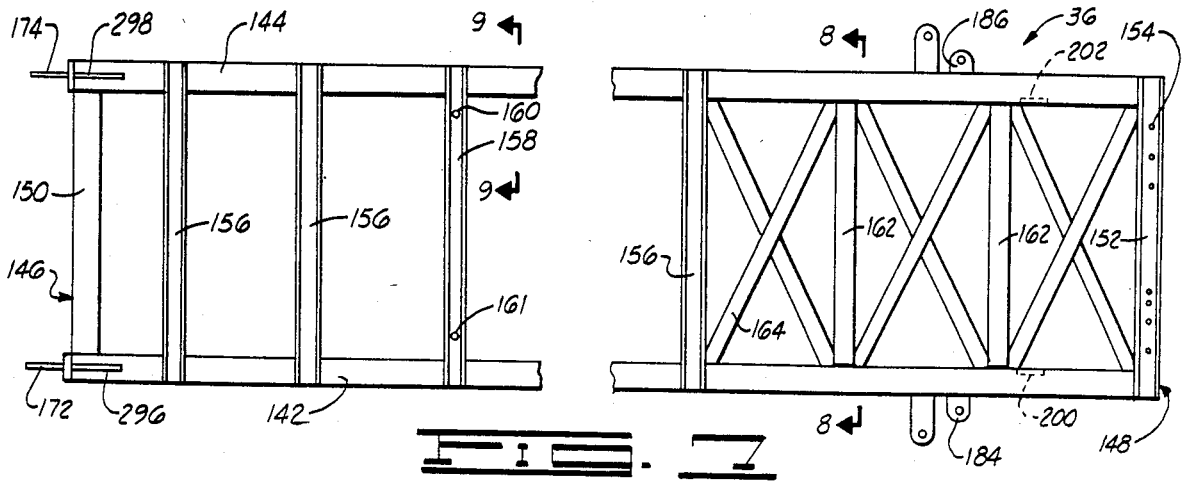
FIG. 7 is a plan view of the secondary frame of the batch plant shown in FIG. 1.
Figure 8:
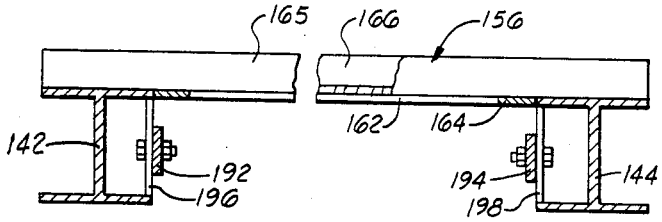
FIG. 8 is a fragmentary cross section of the secondary frame taken along line 8—8 of FIG. 7.
Figure 9:
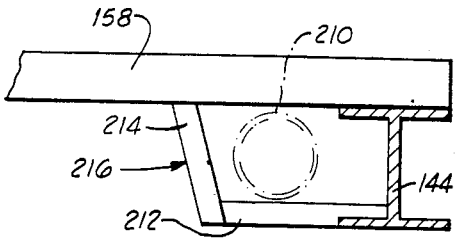
FIG. 9 is a fragmentary cross section of the secondary frame taken along line 9—9 of FIG. 7.

The secondary frame 36, which has been illustrated in FIGS. 7–9, is similarly comprised of two base beams 142 and 144 that extend longitudinally between first and second ends, 146 and 148 respectively, of the secondary frame 36. The base beams 142 and 144 of the secondary frame 36 are constructed of steel H-beam having the same cross sectional dimensions as the base beams 48 and 50 of which the main frame 22 is comprised and a first end beam 150, similarly constructed of steel H-beam connects the base beams 142, 144 together at the first end 146 of the secondary frame 36. At the second end 148 of the secondary frame 36, the base beams 142 and 144 are connected together by a conveyor support beam 152 that is constructed of channel beam welded to the upper sides of the base beams 142 and 144 and extending therebetween. A plurality of holes 154 (only one hole 154 has been numerically designated in the drawings) are formed through the central web of the conveyor support beam 152 for a purpose to be discussed below.

The secondary frame 36 is formed into a rigid structure by a plurality of braces 156, 158 formed of steel channel beam, that are welded to the base beams 142 and 144 to extend across the upper side of the secondary frame 36 in the same manner that the conveyor support beam 152 is welded to the base beams 142 and 144 to extend across the upper side of the secondary frame 36. One of these braces, designated by the numeral 158 in the drawings, is provided with holes 160 and 161 near the base beams 142 and 144 for a purpose to be discussed below. The braces 156 and 158 are mounted on the base beams 142 and 144 for only a selected distance from the first end 146 of the secondary frame 36 for a reason also to be discussed below. Portions of the base beams 142 and 144 near the second end thereof are braced by a plurality of straps, formed into a lattice as shown in FIG. 7, and welded to the upper webs of the base beams 142, 144 as illustrated in FIG. 8. In particular, these straps comprise a plurality of straps 162 that extend perpendicularly to the base beams 142 and 144 and a plurality of straps 164 that extend at an angle to the base beams 142, 144 to form a plurality of X-shaped braces as shown in FIG. 7. (For clarity of illustration, the braces 156 and the straps 162 and 164 have not been illustrated in FIG. 2.)

As can be particularly seen in FIGS. 8 and 9, the outside webs 165 and 166 of the braces 156 are extended upwardly from the base beams 142, 144 and the straps 162, 164 are welded to the uppermost webs of the base beams 142, 144 so that an unobstructed downwardly opening channel is formed longitudinally through central portions of the secondary frame 36. The provision of the unobstructed channel through the central portion of the secondary frame 36 eliminates interference between the secondary frame 36 and the first conveyor 98 when the secondary frame 36 is placed down on the main frame 22 as has been illustrated by the inclusion of the base beams 142, 144 of the secondary frame 36 in dashed line in FIG. 5.

As can also be seen in FIG. 5, the spacing of the base beams 142, 144 of the secondary frame 36 is identical to the spacing of the base beams 48, 50 of the main frame 22 so that the secondary frame 36 can be placed in the first position for transport of the batch plant 20 in which the secondary frame 36 engagingly overlays the main frame 22. In order to mount the secondary frame 36 on the main frame 22, apertured clevises 168 and 170 (FIG. 4) are welded to the upper sides of the main frame base beams 48 and 50 near the first end 26 of the main frame 22 to receive apertured tabs 172 and 174 that are welded to the first end 146 of the secondary frame 36 to extend longitudinally therefrom. The frames 22 and 36 are then connected together via fasteners 176 and 178 that pass through the apertures (not shown) in the clevises 168 and 170 and tabs 172 and 174. In order to secure the secondary frame 36 in the first position overlaying the main frame 22, clamps 177 and 179 (FIG. 2) comprised of apertured plates 180 and 182 (FIG. 4) are welded to the upper webs of the main frame base beams 48 and 50, near the second end 30 of the main frame 22, to extend laterally from the base beams 48 and 50 as shown in FIG. 4, and similar apertured tabs 184 and 186 (FIG. 7) are welded to the lower webs of the base beams 142, 144 of the secondary frame 36 near the second end 148 of the secondary frame 36. When the secondary frame 36 is placed in the second position thereof to engagingly overlay the main frame 22, fasteners 188 and 190 (FIGS. 1 and 2) are passed through the apertures in the plates 180–186 to secure the secondary frame 36 atop the main frame 22.

The secondary frame support assembly 46 is comprised of two braces 192 and 194 that are mounted on facing sides of the secondary frame base beams 142, 144 in the same manner that the brace 128 is mounted along the outside of the base beam 48 of the main frame 22. In particular, and as shown in FIGS. 7 and 8, apertured plates 196 and 198 (FIG. 8) and 200 and 202 (FIG. 7) are welded between the upper and lower webs of the base beams 142, 144 so that the brace 192 can be bolted between the plates 196 and 200 and the brace 194 can be bolted between the plates 198 and 202 to reside within the secondary frame 36 when the secondary frame 36 is positioned atop the main frame 22. Similarly apertured plates 204 and 206 (FIG. 4) are welded between the upper and lower webs of the base beams 48 and 50 of the main frame 22 so that the secondary frame 36 can be braced at the angle 38 to the main frame 22 by unbolting the braces 192 and 194 from the plates 200 and 202, swinging the braces 192 and 194 downwardly and bolting the braces 192 and 194 to the plates 204 and 206 of the main frame 22.

Figure 10:
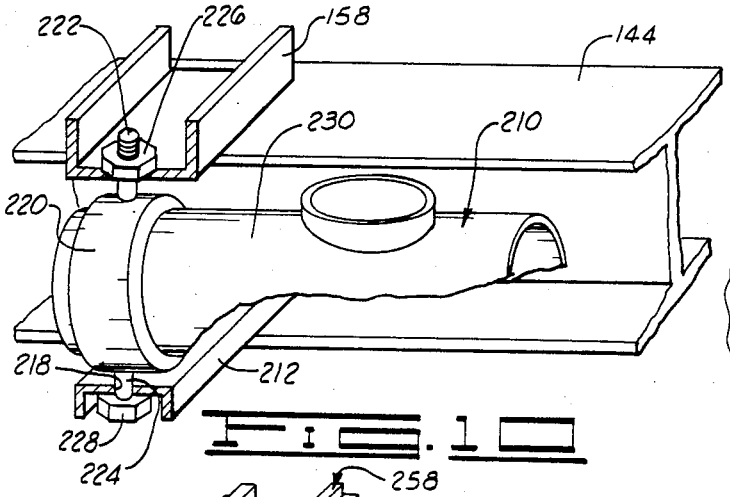
FIG. 10 is an isometric view of a portion of the secondary frame illustrating the pivotal connection of one of the cement conveyors on the secondary frame.
Figure 11:
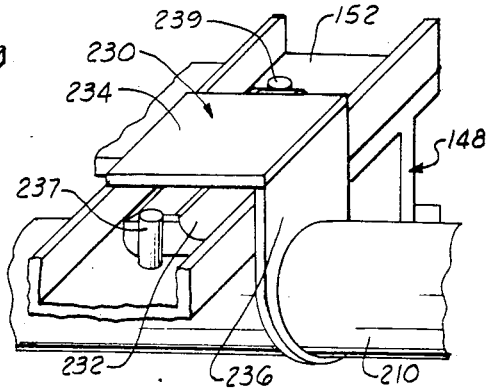
FIG. 11 is an isometric view of a portion of the secondary frame illustrating the manner in which portions of the conveyors shown in FIG. 10 are supported on the secondary frame.

To provide a means of transporting cement from the silo 40 to the cement weigh batcher 92, two screw conveyors 208 and 210 (FIG. 2) are mounted within the secondary frame 36 in a manner that has been illustrated in FIGS. 9–11. As shown in FIGS. 9 and 10, a support member 212, constructed of channel beam, is welded to the lowermost web of the base beam 144 to extend a short distance into the interior of the secondary frame 36 parallel to the brace 158 and a short length of channel member 214 is welded between the brace 158 and the support member 212 to form a conveyor support bracket 216 adjacent the interior side of the base beam 144. An identical conveyor support bracket is formed at the interior side of the base beam 142 to underlie portions of the brace 158 adjacent the base beam 142. As shown in FIG. 10, an aperture 218 is formed through the support member 212 to align with the hole 160 (FIG. 7) formed through the brace 158 to provide for the pivotal mounting of a ring 220 via partially threaded trunnions 222 and 224 that are welded to the ring 220 and extend in a diametrically opposed relation therefrom through the holes 160 and 218 respectively. Nuts 226 and 228 are screwed on the trunnions 222 and 224 respectively, to pivotally mount the ring 220 on the secondary frame 36 as shown in FIG. 10 and the wall 230 of the screw conveyor 210 is welded within the ring 220 to similarly pivotally mount the conveyor 210 on the secondary frame 36. The screw conveyor 208 is identically mounted on the bracket provided therefor adjacent the base beam 142 of the secondary frame 36. Additional support for the screw conveyors in the transport configuration of the batch plant 20 is provided by shelves 221 and 223 (FIG. 5) welded to the interior sides of the main frame base beams 48 and 50 to underlay the support bracket 212 and the similar support bracket provided for the conveyor 208.

As can be seen in FIGS. 1–3, the screw conveyors 208 and 210 protrude from the second end 148 of the secondary frame 36 so that, when the concrete batch plant 20 is placed in the erected configuration thereof, the screw conveyor 208 can be connected to the inlet 94 of the cement weigh batcher 92 and the screw conveyor 210 can be similarly connected to the inlet 96 of the cement weigh batcher 92 in the erected configuration of the concrete batch plant 20. To this end, once the secondary frame 36 has been raised to the first position thereof, the pivotal connection of the screw conveyors 208 and 210 to the secondary frame 36 permits the extensive ends of the screw conveyors 208 and 210 to be shifted inwardly from the secondary frame base beams 142 and 144 to a position in which the screw conveyors 208 and 210 overlay the inlets 94 and 96 respectively. As shown in FIG. 2, the confinement of the cement weigh batcher 92 and the collection hood 88 to the central portions of the main frame 22 permits the screw conveyors 208 and 210 to be positioned about the cement weigh batcher 92 and collection hood 88 by pivoting the screw conveyors 208 and 210 on the secondary frame 36 such that the screw conveyors 208 and 210 extend along the base beams 142 and 144 of the secondary frame 36.

Support for portions of the screw conveyors 208, 210 that extend from the second end 148 of the secondary frame 36 is provided by two identical conveyor supports, one of which, supporting extensive portions of the conveyor 210, has been illustrated in FIG. 11 and designated by the numeral 230 therein. The conveyor support 230 is comprised of a skid 232 that rests on the central web of the conveyor support beam 152 and an L-shaped bracket 234 having one leg welded to the top of the skid 232 and the other leg extending downwardly over the second end 148 of the secondary frame 36. The downwardly extending leg of the bracket 234 is provided with an aperture 236 and the conveyor 210 extends through the aperture 236 and is welded to the bracket 234 to attach the conveyor 210 to the bracket 234. During both transport and use of the batch plant 20, the conveyor 208 is held in a fixed position via pins 237 and 239 that are mounted in selected ones of the holes 154 in the conveyor support beam 152 to engage the ends of the skid 232.

Returning now to FIGS. 1–3, the silo 40 is comprised of a bin support frame 238 that is pivotally attached to the secondary frame 36 and carries a cement bin 240 at the upper end 242 thereof. The cement bin 240 is provided with two converging outlets 244 and 246 positioned generally over the screw conveyors 208 and 210 respectively, so that the outlets 244 and 246 can be connected via boots 248 and 250 to inlets (not numerically designated in the drawings) of the screw conveyors 208 and 210. As can be seen in FIGS. 1–3, the bin 240 is positioned on the bin support frame 238 so that, when the silo 40 is placed in the first position thereof wherein the silo extends generally horizontally, the bin 40 will rest on portions of the secondary frame 36 adjacent the second end 148 thereof so that the bin 240 will be disposed atop the flat portion of the secondary frame 36 formed by the utilization of the straps 162 and 164, rather than braces 156 and 158, to brace portions of the secondary frame 36 near the second end 148 thereof.

As can be seen in FIG. 2, the cement bin 240 is slightly wider than the main frame 22 and secondary frame 36 and the bin support frame 238 is comprised of two U-shaped silo side frames 252 and 254 that are welded to the sides of the cement bin 240 to extend to a lower end 256 of the bin support frame 238. The silo side frames 252 and 254 are thus spaced apart a distance that is greater than the maximum widths of the main frame 22 and secondary frame 36 so that, when the silo 40 is placed in the second position thereof shown in FIG. 3, the silo side frames will extend about the main frame 22 and the secondary frame 36.

Each of the silo side frames 252 and 254 is comprised of a lower leg member 258 and an upper leg member 260 welded to the cement bin 240 in a parallel relation and a base member 262, having a generally arcuate form, that connects the leg members at the lower end 256 of the silo side frames. The generally arcuate form of the base member 262 permits the bin support frame 238 to be pivoted into contact with the earth's surface 32 when the concrete batch plant 20 is erected in a manner that will be discussed below.

Figure 12:
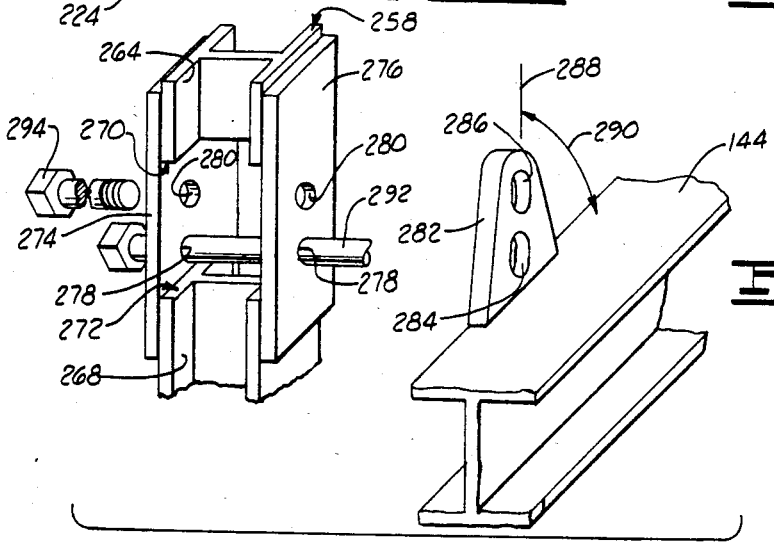
FIG. 12 is an isometric view of portions of the secondary frame and the silo illustrating the manner in which the silo is pivotally attached to the secondary frame.

The pivotal connection between the silo 40 and the secondary frame 36 is formed by pivotally connecting each of the lower leg members 258 of the silo side frames 252, 254 to one of the base beams 142, 144 of the secondary frame 36 in a manner that has been illustrated in FIG. 12 for the connection between the leg member 258 of the silo side frame 254 and the base beam 144. Each of the lower leg members 258 is comprised of an upper section 264, constructed of steel H-beam, that is welded to the cement bin 240 and a lower section 268 that is axially aligned with the upper section 264 and extends to the base member 262 to which the lower section 268 is welded. The sections 264 and 268 terminate, in central portions of the leg member 258, in facing, separated ends 270 and 272 respectively, and the two sections 264 and 268 are connected by two plates 274 and 276 that are welded to opposite sides of the lower leg members 256 so that the plate 276 will be disposed alongside a base beam, such as the base beam 144, when the bin support frame 238 is positioned about the main frame 22 and secondary frame 36 as shown in FIG. 3. Two circular holes 278 and 280 are formed through each of the plates 274 and 276, the hole 278 in the plate 276 being coaxial with the hole 278 in the plate 274 and the hole 280 in the plate 276 similarly being coaxial with the hole 280 in the plate 274. The holes 280 are displaced longitudinally toward the upper end 242 of the bin support frame 238 from the hole 278 so that the holes 278 and 280 will be vertically aligned when the concrete batch plant 20 is placed in the erected configuration that has been illustrated in FIG. 3.

To provide for the connection of the lower leg members 258 to the secondary frame 36, each of the base beams 142, 144 of the secondary frame 36 is provided with a silo attachment plate 282 through which two elongated apertures 284 and 286 are formed to align with the holes 278 and 280 respectively, in the plates 274 and 276. Each of the apertures 284 and 286 is elongated along a line 288 that makes an angle 290 to the base beam whereon the silo attachment plate is mounted and the angle 290 is selected to be equal to the angle 42 (the complement of the sum of the angles 34 and 38) at which the silo 40 extends upwardly from the secondary frame 36 so that the elongated axes of the apertures 284 and 286 will lie along the vertical when the concrete batch plant 20 is placed in the erected configuration shown in FIG. 3. Thus, a pivoting connection, as will now be described, can be made between the silo 40 and the secondary frame 36 that will prevent the weight of the silo 40 from being borne by the secondary frame 36 when the concrete batch plant 20 is placed in the erected configuration. In particular, the silo 40 is connected to the secondary frame 36 via a silo attachment axle 292, having the form of an elongated bolt, that extends through the holes 278 in both plates of each of the lower leg members 258 of the silo side frames 252, 254 and through the apertures 284 through the two silo attachment plates mounted on the base beams 142, 144 of the secondary frame 36. When the plant 20 is erected, bolts 294 are passed through the holes 280 in the plates 274 and 276 of the silo side frames and through the apertures 286 of the silo attachment plates 282 on the secondary frame 36 to partially fix the position of the silo 40 on the secondary frame 36 when the concrete batch plant 20 is in the erected configuration thereof. Nuts (not shown) are used to secure the silo attachment axle 292 within the holes 278 and apertures 284 and to secure the bolts 294 within the holes 280 and apertures 286. Because of the elongated shapes of the apertures 284 and 286, the silo 40 will be free to move vertically on the secondary frame 36 when the concrete batch plant 20 is erected and the lower end 256 of the bin support frame 238 is positioned with respect to the holes 278 so that the lower end 256 will rest on the earth's surface 32 when the concrete batch plant 20 is erected, via the elongation of the apertures 284 and 286, insuring that none of the weight of the silo 40 will be borne by the secondary frame 36 in the erected configuration of the batch plant 20.

In order to positively block the silo 40 into a vertical position in the erected configuration of the batch plant 20, triangular haunches 296 and 298 (FIGS. 3 and 7) are welded to the upper sides of the secondary frame base beams 142, 144 to be engaged by a silo positioning bar 300 that is welded between the upper leg members 260 of the two silo side frames 252 and 254. Thus, when the silo 40 is positioned at the angle 42 with respect to the secondary frame 36, the silo positioning bar 300 will engage the haunches 296 and 298, as shown in FIG. 3, so that the silo 40 will be blocked into position, in the erected configuration of the plant 20, via a coactive relationship between the engagement of the lower end 256 of the bin support frame 238 with the earth's surface 32 and the engagement of the silo positioning bar 300 with the haunches 296 and 298.

When the batch plant 20 is placed in the transport configuration in which the silo 40 engagingly overlays the secondary frame 36, the silo can be clamped to the secondary frame 36 via clamps 302 and 304 which, like the clamps 177 and 179 are comprised of laterally extending apertured plates, two such plates being welded to the silo 40 and two to the upper web of the secondary frame 36, which are disposed in a vertical juxtaposition when the silo 40 is pivoted into an overlaying engagement with the secondary frame 36. Fasteners (a nut and a bolt) are passed through the apertures in the plates of the clamps 302 and 304 to secure the silo 40 to the secondary frame 36.

To facilitate the positioning of the concrete batch plant 20 in the erected and transport configurations, a U-shaped bracket 306 (FIGS. 1–3) is welded to the center of the upper end 308 of the cement bin 240 at the side thereof from which the upper leg members 260 extend so that a cable attached to the bracket 306 can be used to draw the silo 40, the main frame 22 and the secondary frame 36 sequentially upwardly in a manner that will be discussed below. Like the frames 22 and 36, the bin support frame 238 can be provided with bracing which will form the bin support frame 238 into a rigid structure. Such bracing, which is conventional, has not been illustrated in order to simplify and clarify the drawings.

Figure 13:
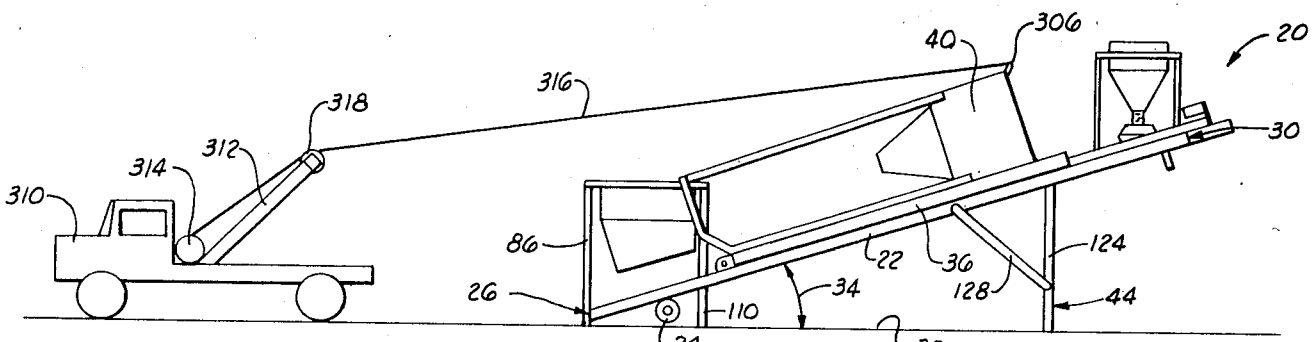
FIG. 13 is a schematic side elevational view of the batch plant in a partially erected configuration.
Figure 14:
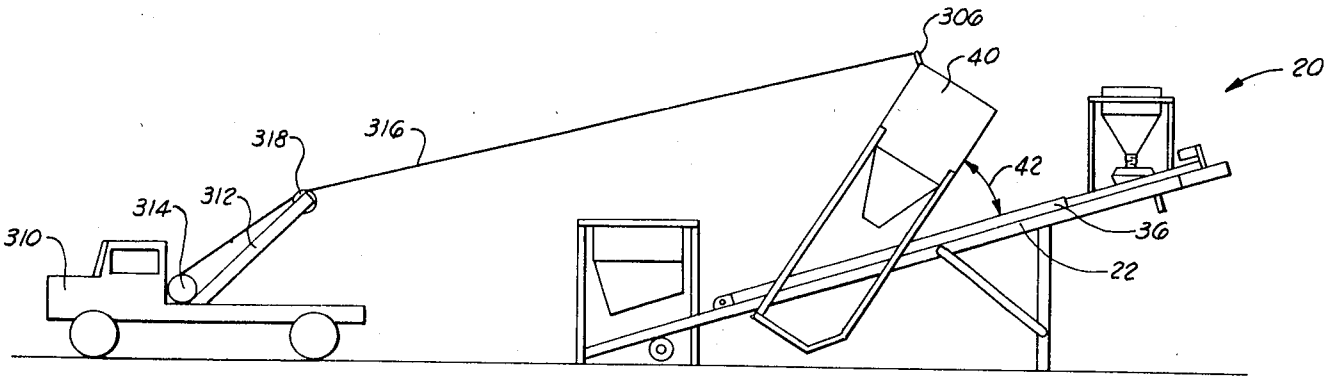
FIG. 14 is a schematic side elevational view illustrating a further stage in the erection of the batch plant.

FIGS. 13 and 14 have been provided to illustrate, with FIGS. 1 and 3, the manner in which the concrete batch plant 20 can be erected utilizing only the truck, designated 310 in FIGS. 13 and 14, which is used to move the batch plant 20 from one site to another. It is contemplated that the truck 310 will be provided with an A-frame 312 and a winch 314 so that a cable 316 can be paid out from the winch 314 and over a pulley 318 at the top of the A-frame 312 to be secured to the bracket 306; for example, via a hook (not shown), at the top of the bin 240 of the silo 40. To initiate the erection of the batch plant 20, the leg 140 on the main frame base beam 48 and a corresponding leg on the base beam 50 are lowered into contact with the earth's surface 32 to support the second end 30 of the main frame 22 so that the truck 310 can be detached from the tow connector 28 and driven to a position, as shown in FIGS. 13 and 14, in which the truck 310 is positioned near the first end 26 of the main frame 22 and facing away from the batch plant 20. The cable 316 is then attached to the bracket 306 and the cable 316 is then drawn in so that the entire batch plant 20 will initially pivot about the wheels 24 and then about portions of the aggregate weigh batcher supporting framework 86 to the position in which the second end 30 of the main frame 22 is raised, such position being shown in FIG. 13. During such pivotation of the batch plant 20, the clamps 177 and 179 that secure the secondary frame 36 to the main frame 22 will remain secured and the clamps 302 and 304 that similarly attach the silo 40 to the secondary frame 36 will similarly be secured so that the batch plant 20 is tilted about the wheels 24 and framework 86 as a unit. When the main frame 22 has reached the angle 34 upwardly from the earth's surface 32, the legs 110 and 124 are lowered as shown in FIG. 13 and bolts (not numerically designated in the drawings) are passed through the lower holes in the clevises and tabs by means of which the legs 110 and 124 are secured to the base beam 48 of the main frame 22 to fix the legs 110 and 124 in a vertical, downwardly extending direction. The corresponding legs on the base beam 50 of the main frame 22 are similarly lowered. The brace 128 mounted on the base beam 48 and the corresponding brace on the base beam 50 are then detached from the plate 132 (FIG. 6) on the base beam 48 and the corresponding plate on the base beam 50 and reattached to the plate 138 on the leg 124 and the corresponding plate on the leg, corresponding to the leg 124 on the base beam 50 to securely support the main frame 22 in the tilted position at the angle 34 with respect to the earth's surface 32 that has been shown in FIGS. 3 and 13.

Following the tilting of the main frame 22, the clamps 302 and 304 that secure the silo 40 in an overlaying, engaging position with the secondary frame 36 are released, by removing the bolts which form a portion of such clamps, and the winch 314 is operated to draw the silo 40 into a position in which the silo positioning bar 300 will engage the haunches 296 and 298 on the secondary frame 36 to bring the plant 20 to the configuration shown in FIG. 14. The clamps 177 and 179 that secure the secondary frame 36 to the main frame 22 are then released, by removing the bolts forming a portion of such clamps from the apertured plates thereof, and the winch 314 is again operated to draw the secondary frame 36 upwardly to a position in which the silo 40 has been pivoted to the vertical with the lower end 256 of the bin support frame 238 thereof pivoting into engagement with the earth's surface as the secondary frame 36 pivots upwardly on the main frame 22. The braces 192 and 194 (FIG. 8) are then unbolted from the plates 200 and 202 and swung to the position shown for the brace 192 in FIG. 3 and bolted to the plates 204 and 206 to support the secondary frame 36 at the angle 38 to the main frame 22. Following the securing of the braces 192 and 194 between the frames 22 and 36, the screw conveyors 208 and 210 are pushed from the secondary frame base beams 142 and 144 toward the center of the secondary frame 36 to align extensive ends of the screw conveyors 208, 210 with the inlets 94 and 96 to the cement weigh batcher 92. The outlets of the screw conveyors 208 and 210 are then connected to the inlets 94, 96 of the cement weigh batcher 92 and the boots 248, 250 on the outlets 244, 246 are connected to the inlets of the screw conveyors 208 and 210. A boot 320 (FIG. 3) is then attached to the lower end of the collection hood 88 for channeling aggregate, cement and water into a concrete mixing truck that is driven under the second end 30 of the main frame 22. The plant 20 can then be placed into operation by connecting a tank truck to the water pipe (not shown) that delivers water to the collection hood 88 and by charging the bin 240 of the silo 40 and the aggregate weigh batcher 84 in a conventional manner.

It will be clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. In a concrete batch plant of the type comprising:

a collection hood for receiving aggregate and cement from separate sources and dispensing the aggregate and cement at a single outlet;

an aggregate weigh batcher for storing and dispensing metered quantities of aggregate;

first conveyor means for conveying said metered quantities of aggregate to the collection hood;

a cement silo for storing cement;

a cement weigh batcher positioned above the collection hood for receiving cement from the cement silo and dispensing metered quantities of cement to the collection hood; and second conveyor means for conveying cement from the silo to the cement weigh batcher, the improvement wherein said plant further comprises:

a mobile, tiltable main frame, having a first end and a second end, wherein the aggregate weigh batcher is mounted on the main frame adjacent the first end thereof, the collection hood and cement weigh batcher are mounted on the main frame in a vertically stacked relation adjacent the second end thereof, and the first conveyor means is mounted on the main frame to extend longitudinally therealong between the aggregate weight batcher and the collection hood;

means for supporting the main frame at an upward angle to the horizontal so as to position the collection hood a preselected height above the ground in an erected configuration of the concrete batch plant;

a secondary frame pivotally attached to the main frame near the aggregate weigh batcher for movement between a first position on the main frame wherein the secondary frame engagingly overlays the main frame and a second position on the main frame wherein the secondary frame extends upwardly at an angle from the main frame; and means for supporting the secondary frame in said second position thereof on the main frame in said erected configuration of the concrete batch plant;

wherein the second conveyor means is mounted on the secondary frame to extend longitudinally therealong; and wherein the silo is pivotally attached to the secondary frame for movement between a first position wherein the silo engagingly overlays the secondary frame and a second position wherein the silo extends upwardly at an angle from the secondary frame, the silo being disposed in said second position thereof in the erected configuration of the concrete batch plant.

2. The batch plant of claim 1 further comprising:

means for clamping the secondary frame in the first position thereof; and means for clamping the silo in the first position thereof.

3. The batch plant of claim 2 wherein the means for clamping the secondary frame in the first position thereof comprises:

a plurality of apertured plates mounted on each of the main frame and secondary frame to extend laterally from said frames in vertical juxtaposition in the first position of the secondary frame; and a plurality of fasteners insertable through said plates on the main frame and secondary frames for maintaining the juxtaposition of said plates; and wherein the means for clamping the silo in the first position thereof comprises:

a plurality of apertured plates mounted on each of the secondary frame and the silo to extend laterally from said secondary frame and silo in vertical juxtaposition in the first position of the silo; and a plurality of fasteners insertable through said plates on the secondary frame and silo to maintain said plates on the secondary frame and silo in vertical juxtaposition.

4. The concrete batch plant of claim 2 wherein the silo comprises:

a bin support frame having a lower end positioned with respect to the pivotation axis of the silo on the secondary frame to rest on the ground in the erected position of the concrete batch plant, the bin support frame comprising two spaced-apart, substantially parallel silo side frames extendable about the sides of the main and secondary frames in the erected position of the concrete batch plant; and a cement bin mounted on the bin support frame.

5. The concrete batch plant of claim 4 further comprising:

a silo positioning bar mounted on the silo side frames and extending therebetween along a side of the silo opposite the side of the silo engaged by the secondary frame in the first position of the silo; and two triangular haunches mounted on the secondary frame in a substantially parallel, spaced-apart relation at opposite sides of the secondary frame to be engaged by the silo positioning bar in said second position of the silo.

6. The concrete batch plant of claim 4 wherein the silo comprises a silo attachment axle attached to the silo side frames and extending therebetween at one side of the bin support frame; wherein the batch plant further comprises two silo attachment plates mounted on the secondary frame at opposite sides of the secondary frame, the silo attachment plates having apertures formed therethrough to receive the silo attachment axle for pivotal mounting of the silo on the secondary frame; and wherein the apertures through the silo attachment plates are elongated along a line at an angle with respect to the longitudinal extent of the secondary frame that is substantially equal to the complement of the sum of the angle to the horizontal at which the main frame is supported in the erected position of the concrete batch plant and the angle at which the secondary frame extends upwardly from the main frame in the second position of the secondary frame on the main frame.

7. The concrete batch plant of claim 6 wherein the secondary frame comprises:

two spaced-apart, longitudinally extending base beams; and a plurality of connecting members extending between the tops of the secondary frame base beams;

wherein the secondary frame has a first end pivotally attached to the base frame near said aggregate weigh batcher and a second end extending to a position near said collection hood; wherein the second conveyor means comprises two screw conveyors pivotally mounted to the underside of one of said connecting members near the first end of the secondary frame so as to be disposed between said base beams, each screw conveyor being connected to said one of the connecting members adjacent one of the base beams and extending through the second end of the secondary frame for positioning distal portions of the screw conveyors about the collection hood and cement weigh batcher in the first position of the secondary frame on the main frame and for pivotation of the screw conveyors on the secondary frame to overlay the cement weigh batcher in the second position of the secondary frame on the main frame; and wherein the concrete batch plant further comprises means for movably supporting portions of the screw conveyors adjacent the second end of the secondary frame.

8. The cement weigh batcher of claim 7 wherein said plurality of connecting members includes a conveyor support beam attached to said base beams to extend across the second end of the secondary frame; and wherein the means for supporting portions of the screw conveyors adjacent the second end of the secondary frame comprises two conveyor supports slidably mounted on the conveyor support beam, each conveyor support comprising:

a skid resting on the conveyor support beam; and an L-shaped bracket having one leg attached to the top of the skid and the other leg extending downwardly across the second end of the secondary frame to attach to one of the screw conveyors.

9. The concrete batch plant of claim 4 wherein the secondary frame comprises:

two spaced-apart, longitudinally extending base beams; and a plurality of connecting members extending between the tops of the secondary frame base beams;

wherein the secondary frame has a first end pivotally attached to the base frame near said aggregate weigh batcher and a second end extending to a position near said collection hood; wherein the second conveyor means comprises two screw conveyors pivotally mounted to the underside of one of said connecting members near the first end of the secondary frame so as to be disposed between said base beams, each screw conveyor being connected to said one of the connecting members adjacent one of the base beams and extending through the second end of the secondary frame for positioning distal portions of the screw conveyors about the collection hood and cement weigh batcher in the first position of the secondary frame on the main frame and for pivotation of the screw conveyors on the secondary frame to overlay the cement weigh batcher in the second position of the secondary frame on the main frame; and wherein the concrete batch plant further comprises means for movably supporting portions of the screw conveyors adjacent the second end of the secondary frame.

10. The cement weigh batcher of claim 9 wherein said plurality of connecting members includes a conveyor support beam attached to said base beams to extend across the second end of the secondary frame; and wherein the means for supporting portions of the screw conveyors adjacent the second end of the secondary frame comprises two conveyor supports slidably mounted on the conveyor support beam, each conveyor support comprising:

a skid resting on the conveyor support beam; and an L-shaped bracket having one leg attached to the top of the skid and the other leg extending downwardly across the second end of the secondary frame to attach to one of the screw conveyors.

11. The concrete batch plant of claim 1 wherein the silo comprises:

a bin support frame having a lower end positioned with respect to the pivotation axis of the silo on the secondary frame to rest on the ground in the erected position of the concrete batch plant, the bin support frame comprising two spaced-apart, substantially parallel silo side frames extendable about the sides of the main and secondary frames in the erected position of the concrete batch plant; and a cement bin mounted on the bin support frame.

12. The concrete batch plant of claim 11 further comprising:

a silo positioning bar mounted on the silo side frames and extending therebetween along a side of the silo opposite the side of the silo engaged by the secondary frame in the first position of the silo; and two triangular haunches mounted on the secondary frame in a substantially parallel, spaced-apart relation at opposite sides of the secondary frame to be engaged by the silo positioning bar in said second position of the silo.

13. The concrete batch plant of claim 11 wherein the silo comprises a silo attachment axle attached to the silo side frames and extending therebetween at one side of the bin support frame; wherein the batch plant further comprises two silo attachment plates mounted on the secondary frame at opposite sides of the secondary frame, the silo attachment plates having apertures formed therethrough to receive the silo attachment axle for pivotal mounting of the silo on the secondary frame; and wherein the apertures through the silo attachment plates are elongated along a line at an angle with respect to the longitudinal extent of the secondary frame that is substantially equal to the complement of the sum of the angle to the horizontal at which the main frame is supported in the erected position of the concrete batch plant and the angle at which the secondary frame extends upwardly from the main frame in the second position of the secondary frame on the main frame.

14. The concrete batch plant of claim 13 wherein the secondary frame comprises:

two spaced-apart, longitudinally extending base beams; and a plurality of connecting members extending between the tops of the secondary frame base beams;

wherein the secondary frame has a first end pivotally attached to the base frame near said aggregate weigh batcher and a second end extending to a position near said collection hood; wherein the second conveyor means comprises two screw conveyors pivotally mounted to the underside of one of said connecting members near the first end of the secondary frame so as to be disposed between said base beams, each screw conveyor being connected to said one of the connecting members adjacent one of the base beams and extending through the second end of the secondary frame for positioning distal portions of the screw conveyors about the collection hood and cement weigh batcher in the first position of the secondary frame on the main frame and for pivotation of the screw conveyors on the secondary frame to overlay the cement weigh batcher in the second position of the secondary frame on the main frame; and wherein the concrete batch plant further comprises means for movably supporting portions of the screw conveyors adjacent the second end of the secondary frame.

15. The cement weigh batcher of claim 14 wherein said plurality of connecting members includes a conveyor support beam attached to said base beams to extend across the second end of the secondary frame; and wherein the means for supporting portions of the screw conveyors adjacent the second end of the secondary frame comprises two conveyor supports slidably mounted on the conveyor support beam, each conveyor support comprising:

a skid resting on the conveyor support beam; and an L-shaped bracket having one leg attached to the top of the skid and the other leg extending downwardly across the second end of the secondary frame to attach to one of the screw conveyors.

16. The concrete batch plant of claim 11 wherein the secondary frame comprises:

two spaced-apart, longitudinally extending base beams; and a plurality of connecting members extending between the tops of the secondary frame base beams;

wherein the secondary frame has a first end pivotally attached to the base frame near said aggregate weigh batcher and a second end extending to a position near said collection hood; wherein the second conveyor means comprises two screw conveyors pivotally mounted to the underside of one of said connecting members near the first end of the secondary frame so as to be disposed between said base beams, each screw conveyor being connected to said one of the connecting members adjacent one of the base beams and extending through the second end of the secondary frame for positioning distal portions of the screw conveyors about the collection hood and cement weigh batcher in the first position of the secondary frame on the main frame and for pivotation of the screw conveyors on the secondary frame to overlay the cement weigh batcher in the second position of the secondary frame on the main frame; and wherein the concrete batch plant further comprises means for movably supporting portions of the screw conveyors adjacent the second end of the secondary frame.

17. The cement weigh batcher of claim 16 wherein said plurality of connecting members includes a conveyor support beam attached to said base beams to extend across the second end of the secondary frame; and wherein the means for supporting portions of the screw conveyors adjacent the second end of the secondary frame comprises two conveyor supports slidably mounted on the conveyor support beam, each conveyor support comprising:

a skid resting on the conveyor support beam; and an L-shaped bracket having one leg attached to the top of the skid and the other leg extending downwardly across the second end of the secondary frame to attach to one of the screw conveyors.

18. The concrete batch plant of claim 1 wherein the secondary frame comprises:

two spaced-apart, longitudinally extending base beams; and a plurality of connecting members extending between the tops of the secondary frame base beams;

wherein the secondary frame has a first end pivotally attached to the base frame near said aggregate weigh batcher and a second end extending to a position near said collection hood; wherein the second conveyor means comprises two screw conveyors pivotally mounted to the underside of one of said connecting members near the first end of the secondary frame so as to be disposed between said base beams, each screw conveyor being connected to said one of the connecting members adjacent one of the base beams and extending through the second end of the secondary frame for positioning distal portions of the screw conveyors about the collection hood and cement weigh batcher in the first position of the secondary frame on the main frame and for pivotation of the screw conveyors on the secondary frame to overlay the cement weigh batcher in the second position of the secondary frame on the main frame; and wherein the concrete batch plant further comprises means for movably supporting portions of the screw conveyors adjacent the second end of the secondary frame.

19. The cement weigh batcher of claim 18 wherein said plurality of connecting members includes a conveyor support beam attached to said base beams to extend across the second end of the secondary frame; and wherein the means for supporting portions of the screw conveyors adjacent the second end of the secondary frame comprises two conveyor supports slidably mounted on the conveyor support beam, each conveyor support comprising:

a skid resting on the conveyor support beam; and an L-shaped bracket having one leg attached to the top of the skid and the other leg extending downwardly across the second end of the secondary frame to attach to one of the screw conveyors.

* * * * *